US007409069B2

(12) United States Patent
Fletcher et al.

(10) Patent No.: US 7,409,069 B2
(45) Date of Patent: Aug. 5, 2008

(54) FACEPLATE MOAT AND CUT OUT FOR HEARING INSTRUMENT

(75) Inventors: Thomas Geoffery Fletcher, Millgrove (CA); Paul Simon Coote, Niagara on the Lake (CA); David Alan Roy, Port Colborne (CA)

(73) Assignee: Sound Design Technologies, Ltd., Burlington, Ontario, CA (US)

( * ) Notice: Subject to any disclaimer, the term of this patent is extended or adjusted under 35 U.S.C. 154(b) by 266 days.

(21) Appl. No.: 11/003,667

(22) Filed: Dec. 3, 2004

(65) Prior Publication Data

US 2006/0120547 A1 Jun. 8, 2006

(51) Int. Cl.
*H04R 25/00* (2006.01)

(52) U.S. Cl. ..... 381/322; 381/324

(58) Field of Classification Search ..... 381/312, 381/322, 324, 328; 156/500, 526; 181/129, 181/130, 135; 264/275, 138; 29/896.2, 896.21, 29/896.23, 594
See application file for complete search history.

(56) References Cited

U.S. PATENT DOCUMENTS 3,598,928 A * 8/1971 Hickox ..... 381/324
5,784,470 A * 7/1998 Fackler et al. ..... 381/328
5,903,068 A * 5/1999 Suzuki ..... 29/594
2003/0123687 A1 * 7/2003 Petrick et al. ..... 381/322

OTHER PUBLICATIONS

Website print out from www.intech-ind.com; "InTech Industries, Incorporated: Our Products—Faceplates", 3 pages, 1999.

* cited by examiner

*Primary Examiner*—Brian Ensey
(74) *Attorney, Agent, or Firm*—Van Dyke, Gardner, Linn & Burkhart, LLP

(57) ABSTRACT

A hearing instrument includes a faceplate and a shell. The faceplate is a round plate that has a moat defined in the surface of the plate and at least one feature associated with the plate for joining with a hearing instrument component. The moat is a trench or channel that is defined in the surface of the faceplate and includes a wall structure for coupling with a shell of a hearing instrument. The moat may be defined symmetrically about the at least one feature. The moat may be oval in shape and have a rectangular cross-section. A cut out is positioned on the faceplate for use in speeding the excising of material from the faceplate once the shell has been coupled to the faceplate.

15 Claims, 5 Drawing Sheets

FACEPLATE MOAT AND CUT OUT FOR HEARING INSTRUMENT

FIELD

This technology relates to a hearing instrument. In particular, the technology concerns a faceplate moat for a hearing instrument or a cut out on a faceplate.

BACKGROUND

The casing of an in-the-ear hearing instrument is typically constructed from two separate pieces of plastic. The first piece is known as the faceplate 10, depicted in FIG. 1, and the second piece is known as the shell. The faceplate 10 is typically a relatively flat sheet of material and the shell is generally horn-shaped and molded to fit inside a user's ear. The faceplate 10 normally has a variety of features 12 to accommodate the installation of other components. The shell is designed to house the inner workings of the hearing instrument. The inner workings of the hearing instrument are the parts that attach to the features 12 on the faceplate 10.

The faceplate and shell are constructed to mate vertically, so that the shell seats on the faceplate. In addition, the faceplate and shell must be rotationally aligned before being permanently glued together. This alignment often poses an issue for the builder of the hearing instrument.

The shell is glued to the faceplate along the shell wall thickness to join the faceplate to the shell. Once the faceplate is glued to the shell, the faceplate is typically cut to provide a clean connection where the shell is glued to the faceplate. The strength of the shell to faceplate interface is a direct function of the shell thickness. The thicker the shell, the greater the contact area with the faceplate. With soft shells, as the thickness increases, the pliability of the shell decreases. When soft shell assemblies are squeezed, especially near the interface with the faceplate, delamination of the shell from the faceplate is a concern.

One manufacturer, InTech Industries, Inc. of Ramsey, N.J., utilizes a faceplate with small protrusions on the inner surface of the faceplate that assist in aligning the faceplate to a prefabricated hard shell.

SUMMARY

A faceplate for a hearing instrument is described that includes a moat and/or a cut out for excising material from the faceplate.

BRIEF DESCRIPTION OF THE DRAWINGS FIGURES

DETAILED DESCRIPTION

Figure 1:
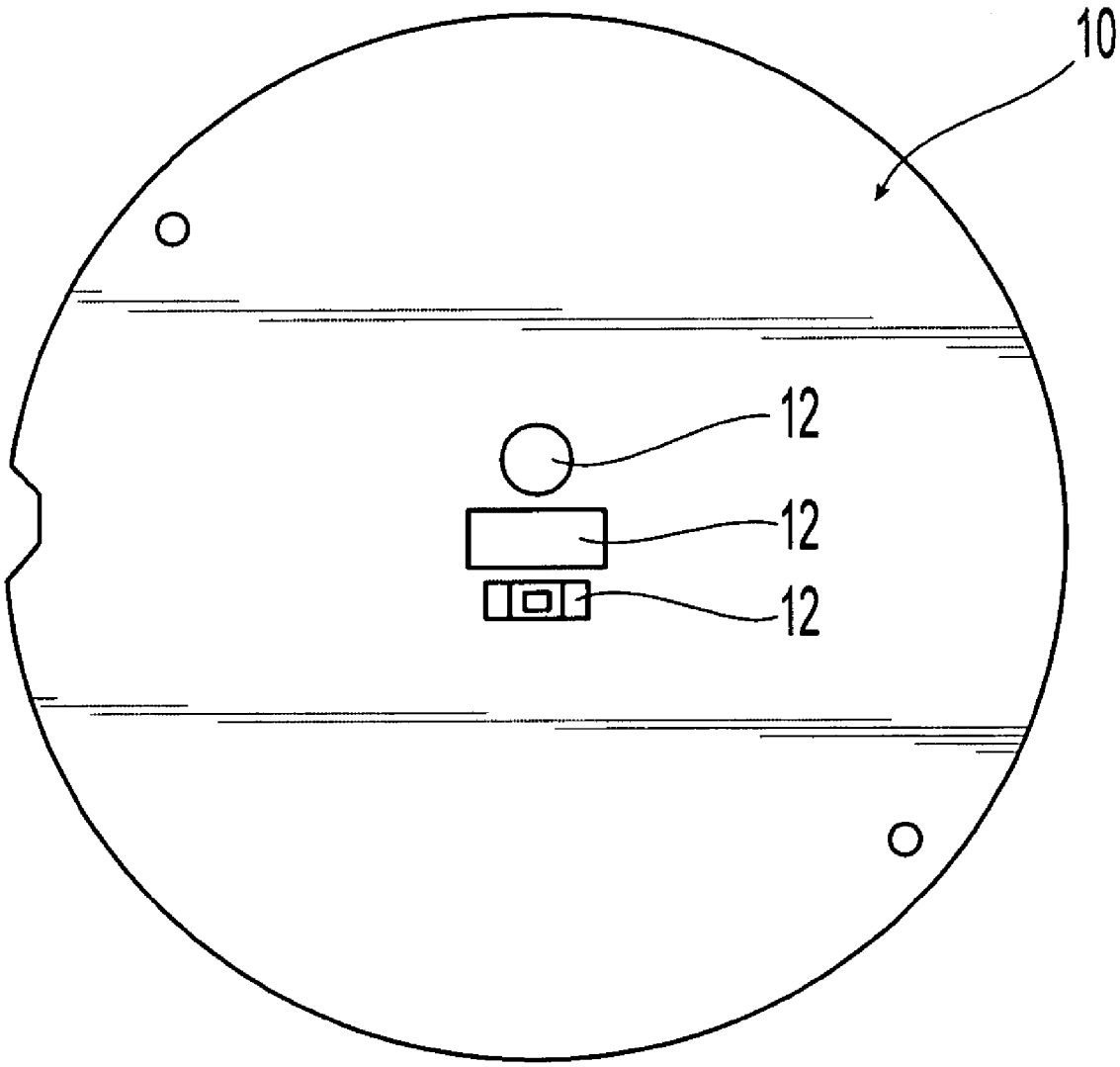
Fig. 1 (Prior Art)
FIG. 1 is a top view of a prior art faceplate.
Figure 2:
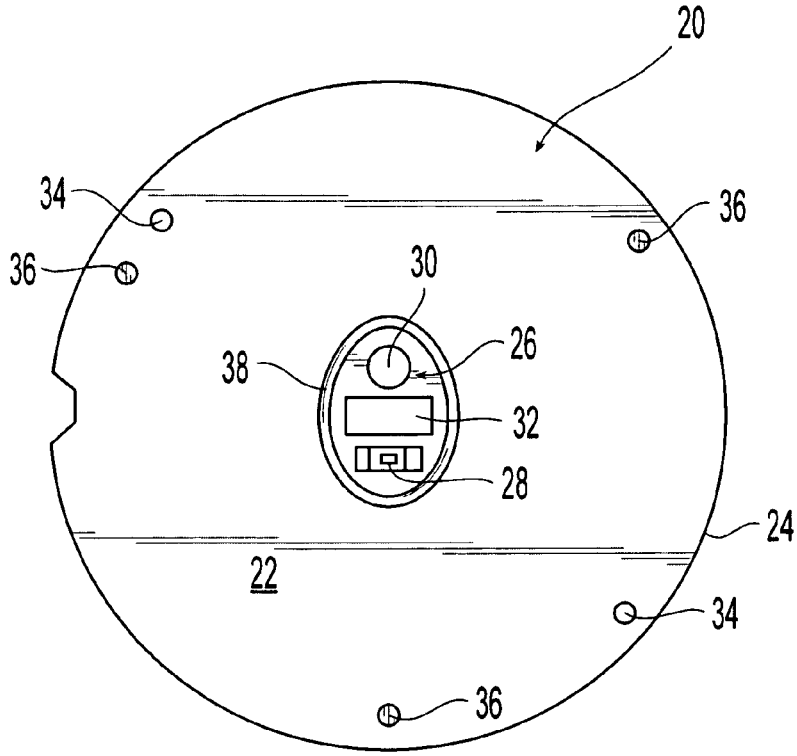
FIG. 2 is a top view of an example faceplate incorporating a faceplate moat.
Figure 3:
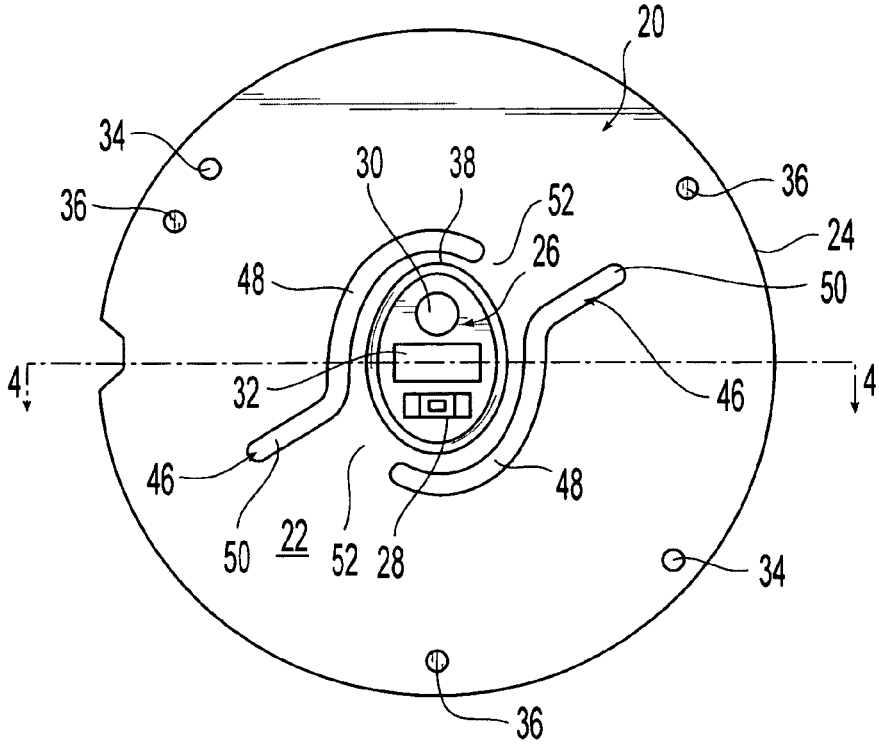
FIG. 3 is a top view of an alternative example of the faceplate incorporating a faceplate moat.
Figure 4:
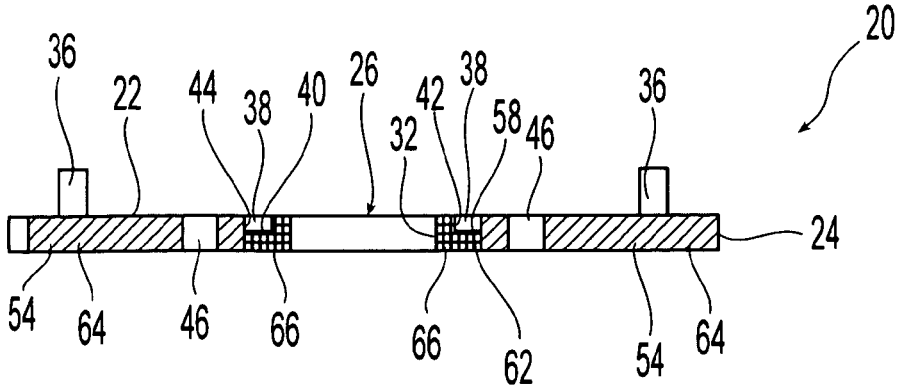
FIG. 4 is a cross-sectional view of the faceplate of FIG. 3.

With reference now to the drawings, FIGS. 2-4 depict a faceplate 20 of a hearing instrument. The faceplate 20 is designed to be coupled to a shell 18 of the hearing instrument, as shown in FIGS. 5-9. The shell 18 may be hard or soft. The faceplate 20 has an upper surface 22 and an outer periphery 24. The shell 18 is coupled to the upper surface 22 during installation.

FIG. 2 depicts one example of the faceplate 20 as a generally flat plate member that is round, with features 26 positioned in the center of the faceplate 20. The features 26 are used to couple to hearing instrument components. These components comprise the inner workings of the hearing instrument and include such things as a microphone, battery and volume controller. The features may be molded, wired, soldered or glued onto the faceplate 20 and are designed to couple to the inner workings of the hearing instrument and to provide access to the inner workings, when necessary. Thus, the features 26 include access ports such as a microphone access port 28, a volume control access port 30, and a battery access port 32, for example. Other features 26 may also be utilized for connecting to the inner workings of the hearing instrument, or for other purposes. Several holes 34 and posts 36 also encircle the faceplate 20 at the outer periphery 24 thereof. As known by those of skill in the art, the holes 34 are utilized for aligning the faceplate 20 during its manufacture, and the posts 36 act as stand offs to space the upper surface 22 of the faceplate 20 from another object or surface. The posts 36 provide protection to the wires and circuits that are connected to the faceplate 20.

The example faceplate 20 includes a moat 38 that is cast or machined into the faceplate 20. The moat 38 is a trench or channel that surrounds the features 26. In the embodiment shown in FIG. 2, the moat 38 is centrally located, oval shaped, and positioned symmetrically about the features 26. Other shapes and positions for the moat 38 may also be used, but it is preferred that the shell 18 have a shape at its base 56 that is similar to the shape of the moat 38. The moat 38 is cut into the upper surface 22 of the faceplate 20 and extends partially through the plate.

FIG. 4 shows the moat 38 in cross-section. In this embodiment, the moat 38 has a rectangular cross-section with a bottom wall 40, an inner side wall 42, and an outer side wall 44. The moat 38 may alternatively have other shapes, such as square, U-shaped, or other shapes. The shape of the moat 38 may vary depending upon the type of manufacturing operation used to create the moat 38, as discussed in greater detail below.

FIG. 3 depicts another example faceplate 20 having a moat 38 and features 26. In this embodiment, two cut-outs 46 are positioned symmetrically about the moat 38 through the surface of the faceplate 20. The cut-outs 46 preferably extend entirely through the faceplate 20, but some embodiments include cut-outs in the form of trenches or thinned areas on the faceplate 20 in the vicinity of the moat 38, or a combination of thinned areas and holes. In the embodiment depicted, each cut-out 46 is elongated and includes an arcuate part 48 and a leg 50 that extends away from the arcuate part 48, such that each cut-out 46 resembles a question mark. The arcuate part 48 partially encircles the moat 38. The cut-outs 46 create two spokes 52 that are positioned between the cut-outs and provide an area that maintains the stability of the faceplate 20 during assembly. The cut-outs 46 are utilized in removing the outer faceplate material 54 after the shell 18 has been coupled to the faceplate 20, as will be described in greater detail below. The cut-outs 46 also allow the faceplate 20 to maintain a larger size for ease in handling during assembly and manufacturing steps. Other shapes may also be utilized for the cut-outs, the example faceplate 20 not being limited to the depicted shape. In addition, while two cut-outs 46 are shown, other designs may be utilized that use a single cut-out, or greater than two cut-outs. The cut-outs may be formed using a milling operation, or may be molded into the faceplate 20.

As shown in FIG. 4, the faceplate moat 38 includes a wall structure that is defined by a bottom wall 40, inner side wall 42, and outer side wall 44. The moat 38 has a rectangular shape in this embodiment that is created by a milling operation utilizing a butt end mill, which is a milling tool that produces a rectangular cut that has negligible radii from the bottom wall 40 to the side walls 42, 44. A radius or other cutter could alternatively be utilized, or the moat 38 could be molded into the faceplate 20.

The wall structure of the moat 38 provides a method for glue containment that is useful during the coupling of the faceplate 20 to the shell 18. Glue is inserted into the moat 38 prior to insertion of the faceplate 20 into the shell 18. The glue is contained within the moat 38 by the walls 40, 42, 44 of the moat 38, which helps to deter contaminating other parts of the assembly.

The bottom wall 40 of the moat 38 mimics a conventional shell base edge to faceplate glue contact area 58. The inner wall 42 of the moat 38 provides a contact area not previously present that greatly increases the glue contact area 58, on the order of double that of prior art methods. Because of this increase in glue contact area 58, the shell wall thickness can be reduced in order to maximize pliability of the shell 18 while maintaining joint integrity.

The moat 38 promotes speed, accuracy, and strength of attachment when the faceplate 20 is coupled to a soft shell 18. In prior art constructions, the area surrounding the features 26 on the faceplate 20 was flat. This flat area offered no visual or mechanical assistance to the builder of the hearing instrument to properly locate the shell 18 relative to the faceplate 20. As a result, faceplates were often located off center and/or rotated improperly with respect to other features 26 of the hearing instrument. The example faceplate moat 38 serves as a guide to the builder of the hearing instrument to precisely locate the shell 18 prior to coupling the faceplate 20 to the shell 18.

In the depicted embodiments, the moat 38 is symmetrical, as well as oval. This combination insures that the soft shell 18 will only attach to the moat 38 in two possible ways—the correct way and a 180° rotated incorrect way. The builder of the hearing instrument is required to insure crude orientation and the moat 38 assists in ensuring exact orientation. While a symmetrical moat 38 is preferred, non-symmetrical moats may alternatively be utilized. In nonsymmetrical moats, the shell 18 may be attached in only one orientation so that the builder is assured to mate the shell 18 in the proper orientation.

With the soft wall shell 18 construction, it is often difficult to maintain the proper outer radius of the shell 18 during mating of the shell 18 to the faceplate 20. In addition, the attachment area of the shell 18 to the faceplate 20 is limited by the shell wall thickness, since soft wall shells 18 typically do not include any internal mechanical strengthening. The inner side wall 42 of the example faceplate moat 38 helps to hold the shell 18 at its proper radius, especially when mating pressure is applied when the faceplate 20 is coupled to the shell 18. The inner side wall 42 of the faceplate moat 38 also increases the glue contact area 58 of the shell 18 to the faceplate 20 and adds mechanical strength to the hearing instrument, when assembled. The outer side wall 44 of the moat 38 also holds the shell 18 securely in position when the shell 18 is compressed during the glue application. This helps to ensure sound glue joint formation. The moat 38 applies a compressive or expansive force on the shell wall, which compensates for any variations in shell 18 circumference and thickness.

Figure 5:
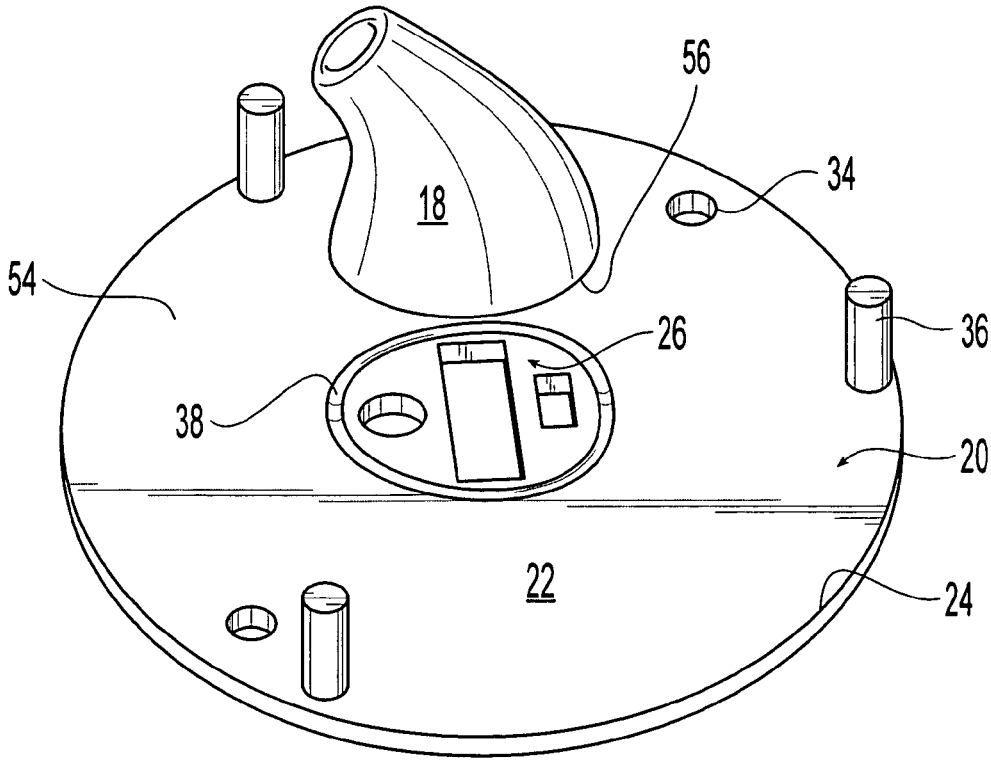
FIG. 5 is perspective view of an example faceplate and shell prior to installation of the shell on the faceplate.

FIGS. 5-9 show the shell 18 and faceplate 20 prior to and during assembly. FIG. 5 shows the shell 18 positioned on the faceplate 20 prior to assembly. The base 56 of the shell has a size that is compatible with the size and shape of the moat 38 so that the base 56 of the shell may seat within the moat 38. In one embodiment (not shown), the shell 18 is slightly undersized and is pressed into the moat 38 after the glue has been inserted into the moat 38. Because of the size of the shell 18 relative to the moat 38 in this embodiment, the shell 18 stays in place and makes a strong glue seam.

Figure 6:
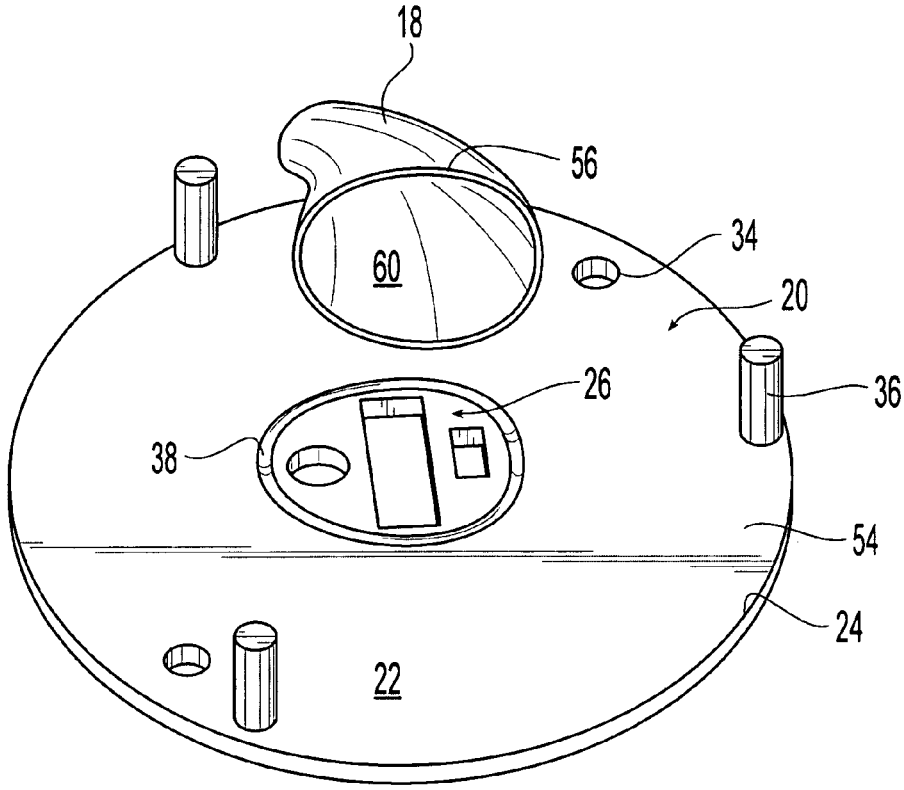
FIG. 6 is a perspective view similar to FIG. 5, but with the shell positioned on its side to reveal its hollow opening.
Figure 7:
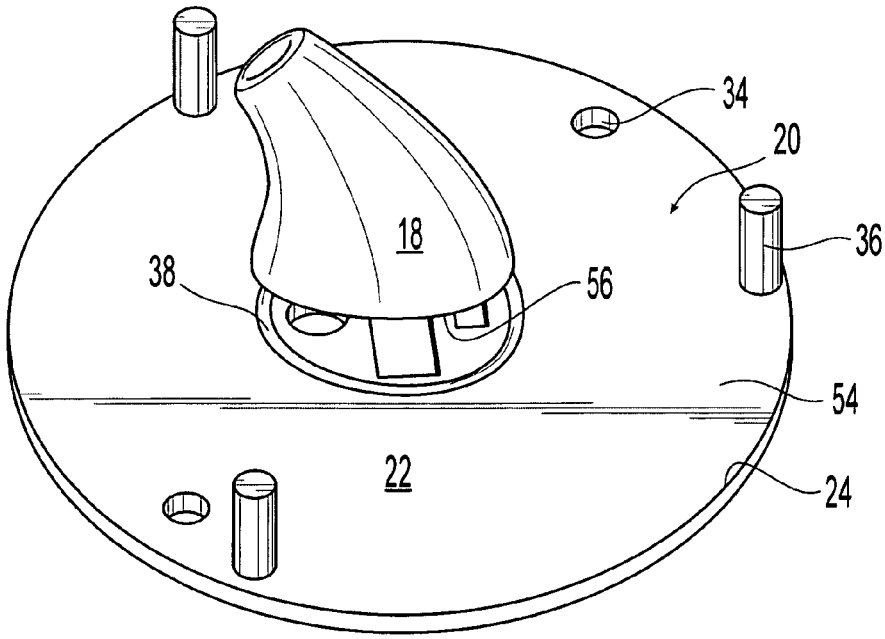
FIG. 7 is a perspective view of the shell of FIG. 5 being installed on the example faceplate.
Figure 8:
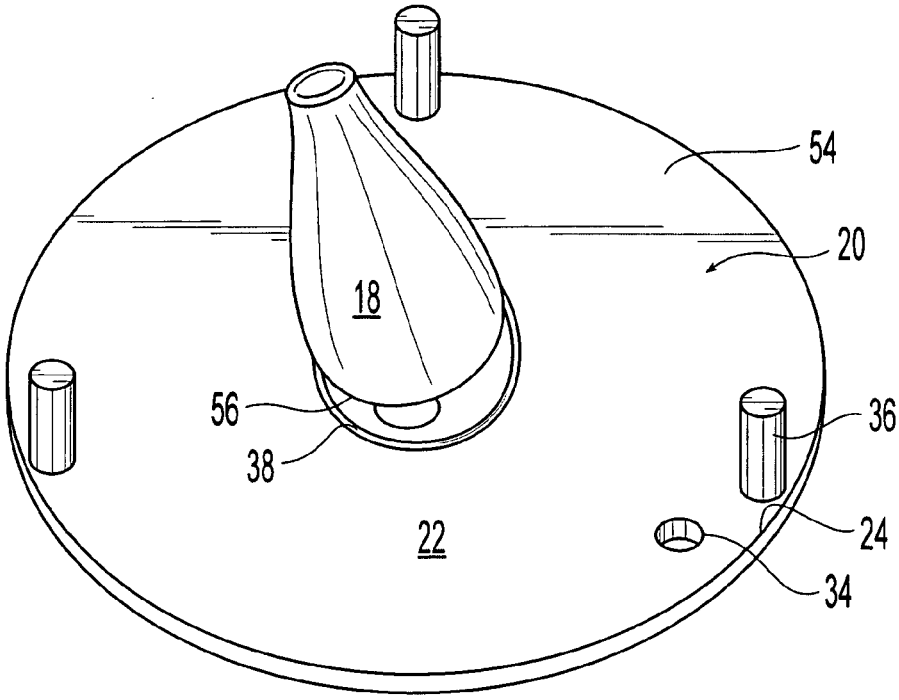
FIG. 8 is another perspective view of the shell of FIG. 5 being installed on the example faceplate.
Figure 9:
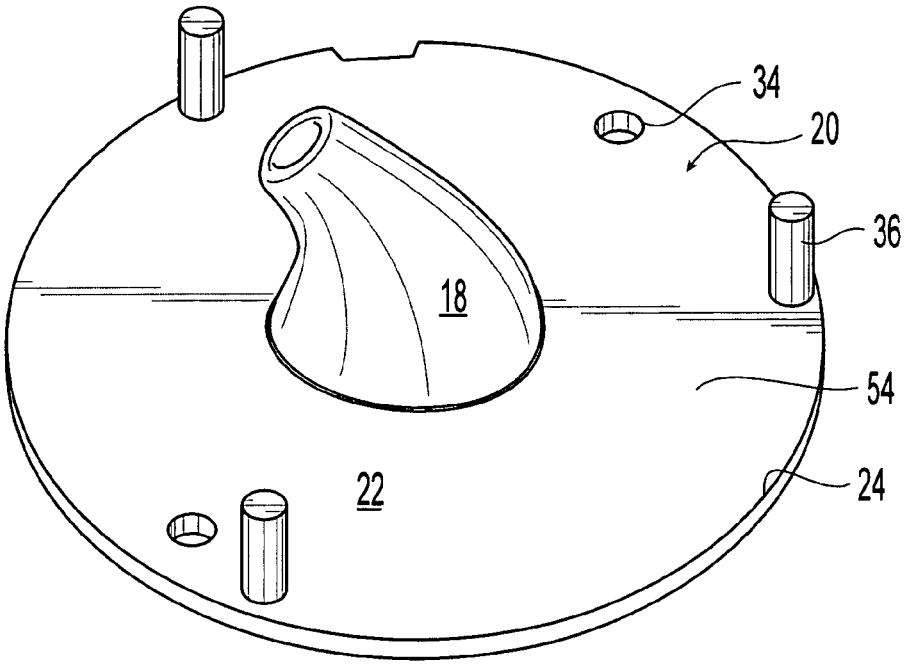
FIG. 9 is a perspective view of the shell of FIG. 5 installed on the faceplate.

FIG. 6 depicts the shell 18 on its side and reveals the hollow interior 60 of the shell 18. In operation, the shell 18 houses components, such as a battery, circuitry, a microphone, a speaker, and a volume controller, among other parts. The depicted shell 18 has an oval shape at its base 58 that is compatible with the shape of the moat 38. In FIGS. 7 and 8, glue is positioned in the moat 38 and the base 58 of the shell is positioned inside the moat 38 where the glue joins the faceplate 20 to the shell 18. FIG. 9 depicts an installed shell 18 on the faceplate 20 prior to removal of excess material of the faceplate 20.

During the assembly process, once the shell 18 is seated in the moat 38, movement is unlikely. Even with the application of a shear force to the shell 18, the moat 38 promotes stability of the attachment. If a stronger than required compressive force is applied to the shell 18 during glue curing, a slight buckling or bulging may occur in the shell 18 above the moat 38, but this will self restore when the pressure is released. The use of the moat 38 promotes added strength to the finished assembly and results in a more robust product with minimized problems associated with delamination of the shell 18 from the faceplate 20. In addition, the moat 38 serves as a quick dimension check for the shell 18 and simultaneously gauges the shell 18 for both circumference and thickness dimensions.

Referring to FIG. 4, once the shell 18 has been glued to the faceplate 20, a cutting operation is necessary to remove the remainder of the faceplate 20 from the shell 18. In particular, the outer portion 64 of the faceplate 20 is excised to the point 62 where it mates with the shell 18. This excised area is represented by the outer-cross-hatched area 64 in FIG. 4. The inner cross-hatched area 66 remains after the outer area 64 is excised. As discussed above, the cut-outs 46 that are positioned around the moat 38 are utilized to assist the builder of the hearing instrument in cutting away the outer portion 64 of the faceplate 20 after assembly. The cut-outs 46 are preferably sized so that a builder can insert a cutting tool, such as the bit of a Dremel™ tool into the openings. The cut-outs 46 allow the builder to form the final hearing instrument more quickly because less material needs to be cut away. Cutting time may be reduced on the order of about 50% or greater. The cut-outs 46 also provide an insertion point for the cutting tool bit.

If the shell 18 of the hearing instrument is ever in need of replacement, the remaining example faceplate structure may act as a guide in removing the old shell. Once the faceplate 20 is cleared from the old shell and glue residue, a new shell 18 may be attached easily.

The example faceplate moat 38 may be utilized with any hearing instrument, assisted listening device, or ear bud that uses a faceplate 20. In addition, while the example faceplate moat 38 was discussed primarily in connection with a soft shell, it may also be utilized with equal success with a hard shell.

While various features of the claimed embodiments are presented above, it should be understood that the features may be used singly or in any combination thereof. Therefore, the claimed embodiments are not to be limited to only the specific embodiments depicted herein.

Further, it should be understood that variations and modifications may occur to those skilled in the art to which the claimed embodiments pertains. The embodiments described herein are exemplary. The disclosure may enable those skilled in the art to make and use embodiments having alternative elements that likewise correspond to the elements recited in the claims. The intended scope may thus include other embodiments that do not differ or that insubstantially differ from the literal language of the claims. The scope of the example embodiments is accordingly defined as set forth in the appended claims.

What is claimed is:

1. A faceplate for a hearing instrument comprising:

a single plate having at least one feature for coupling to a hearing instrument component, a top surface and a periphery; and a moat defined in the top surface of the plate spaced from the periphery, said moat including at least one trench defined partially through the plate, said trench defining a wall structure, wherein the wall structure comprises an inner side wall and a bottom wall.

2. The faceplate of claim 1, wherein the plate is flat and round.

3. The faceplate of claim 2, wherein the at least one trench is oval shaped and has a rectangular cross-section.

4. The faceplate of claim 1, further comprising at least one cut out positioned at least partially around the moat, said cut out extending through the faceplate.

5. The faceplate of claim 4, wherein the at least one cut out is question-mark shaped.

6. The faceplate of claim 4, wherein the at least one cut out is two elongated cut outs that together symmetrically encircle the moat, with two spokes being defined on the faceplate between the cut outs.

7. The faceplate of claim 1, wherein the moat is defined symmetrically about the at least one feature in a continuous loop.

8. The faceplate of claim 1, wherein the moat is defined symmetrically about the at least one feature in a continuous loop.

9. A hearing instrument for housing hearing instrument components comprising:

a faceplate comprising a single plate having at least one feature for coupling to a hearing instrument component, a top surface and a periphery; and a moat defined in the top surface of the plate spaced from the periphery, said moat including at least one trench defined partially through the plate, said trench defining a wall structure;

a shell coupled to the faceplate in contact with the wall structure of the moat; and a plurality of hearing instrument components positioned inside the shell and coupled to the at least one feature of the faceplate.

10. A faceplate for a hearing instrument comprising:

a single plate having at least one feature for coupling to a hearing instrument component, a top surface, and a periphery; and a moat defined in the top surface of the plate spaced from the periphery of the plate, said moat including at least one channel defined in the plate configured to mate with a base of a shell.

11. The faceplate of claim 10, wherein the plate is flat and round and the at least one channel is oval shaped and has a rectangular cross-section.

12. The faceplate of claim 10, further comprising at least one cut out positioned at least partially around the moat, said cut out extending through the faceplate.

13. The faceplate of claim 12, wherein the at least one cut out is two elongated cut outs that together symmetrically encircle the moat, with two spokes being defined on the faceplate between the ends of the cut outs.

14. A hearing instrument for housing hearing instrument components comprising:

the faceplate of claim 10;

a shell coupled to the faceplate; and a plurality of hearing instrument components positioned inside the shell and coupled to the at least one feature of the faceplate.

15. A faceplate for a hearing instrument comprising:

a single plate having at least one feature for coupling to a hearing instrument component, a top surface and a periphery;

means for glue containment for coupling a shell of a hearing instrument to a faceplate; and means for decreasing cutting time during the building of a hearing instrument, said means being spaced from the periphery of the plate and positioned in the vicinity of the at least one feature.

* * * * *